United States Patent [19]

Maier

[11] Patent Number: 4,551,597

[45] Date of Patent: Nov. 5, 1985

[54] MOLDED CASE CIRCUIT BREAKER WITH ADJUSTABLE STATIONARY LOWER ELECTRICAL CONTACT

[75] Inventor: Alfred E. Maier, Chippewa, Pa.

[73] Assignee: Westinghouse Electric Corp., Pittsburgh, Pa.

[21] Appl. No.: 562,644

[22] Filed: Dec. 19, 1983

[51] Int. Cl.[4] ..... H01H 1/34

[52] U.S. Cl. ..... 200/249

[58] Field of Search ..... 200/244, 249, 250, 251, 200/286, 153 G

[56] References Cited

U.S. PATENT DOCUMENTS

| | | | |
|---|---|---|---|
| 2,757,254 | 7/1956 | Wells et al. | 200/286 |
| 2,820,858 | 1/1958 | Tompkins | 200/286 |
| 2,827,535 | 3/1958 | Simons | 200/286 |
| 3,200,213 | 8/1965 | Murphy | 200/286 |
| 4,144,427 | 3/1979 | Gryctko et al. | 200/153 G |
| 4,214,136 | 7/1980 | Rossi et al. | 200/286 |
| 4,273,979 | 6/1981 | Berndt et al. | 200/153 G |

*Primary Examiner*—John W. Shepperd
*Attorney, Agent, or Firm*—M. S. Yatsko

[57] ABSTRACT

A molded case circuit breaker includes an adjustable stationary lower electrical contact having a one-piece formed conductive contact and a separately formed spacer bracket. One longitudinal end of the formed contact forms an external electrical terminal of the circuit breaker. The formed contact also includes a base portion and a stationary contact arm that has a contact for physically and electrically contacting a movable upper electrical contact of the circuit breaker fixedly secured at its other longitudinal end. The spacer bracket includes a base portion spaced above the base portion of the formed contact by a plurality of deflectable legs. The spacer bracket also includes a contact support portion fixedly secured to the underside of the stationary contact arm. A threaded aperture is formed through the base portion of the spacer bracket for the receipt of a mounting screw. By tightening or loosening the mounting screw, the vertical distance between the contact secured to the stationary contact arm and the base of the circuit breaker can be precisely adjusted and maintained. Blow-apart capability is provided by the elongated current path through the stationary contact arm that is generally parallel to an elongated current path along the movable upper electrical contact.

9 Claims, 5 Drawing Figures

MOLDED CASE CIRCUIT BREAKER WITH ADJUSTABLE STATIONARY LOWER ELECTRICAL CONTACT

CROSS REFERENCE TO RELATED APPLICATIONS

The invention disclosed herein relates to molded case circuit breakers. The inventions disclosed in the following four commonly assigned United States patent applicatons also relate to molded case circuit breakers: U.S. patent application Ser. Nos. 440,680; 440,681; 440,682; and 440,683, all of which were filed on Nov. 10, 1982.

The following five commonly assigned U.S. patent applications were filed in the U.S. Patent and Trademark Office on Dec. 19, 1983, on the same day as this patent application and also relate to molded case circuit breakers: Ser. No. 562,647 filed by Alfred E. Maier and entitled Molded Case Circuit Breaker With An Apertured Molded Cross Bar For Supporting A Movable Electrical Contract Arm; Ser. No. 562,648 filed by Robert H. Flick and Walter K. Huffman and entitled Molded Case Circuit Breaker With Movable Upper Electrical Contact Positioned By Tension Springs; Ser. No. 562,643 filed by Robert H. Flick and Walter K. Huffman and entitled Molded Case Circuit Breaker With Improved Operating Mechanism Ser. No. 562,602 filed by Robert H. Flick and Walter K. Huffmann and entitled Molded Case Circuit Breaker With Movable Lower Electrical Contact; and Ser. No. 562,603 filed by Robert H. Flick and Walter K. Huffman and entitled Molded Case Circuit Breaker With Movable Upper Electrical Contact Positioned By Torsion Springs.

BACKGROUND OF THE INVENTION

A. Field of the Invention

The device of the present invention generally relates to molded case circuit breakers and, more particularly, to electrical contacts used in such circuit breakers.

B. Description of the Prior Art

Circuit breakers and, more particularly molded case circuit breakers are old and well known in the prior art. Examples of such devices are disclosed in U.S. Pat. Nos. 3,525,959; 3,614,685; 3,815,059; 3,863,042; 4,077,025; and 4,166,205. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized a trip mechanism for controlling the movement of an over-center toggle mechanism to separate a pair of electrical contacts upon an overload condition or upon a short circuit or fault current condition. Such trip mechanisms have included a bimetal movable in response to an overload condition to rotate a trip bar, resulting in the movement of the over-center toggle mechanism to open a pair of electrical circuit breaker contacts. Such prior art devices have also utilized an armature movable in response to the flow of short circuit or fault current to similarly rotate the trip bar to cause the pair of contacts to separate. At least some prior art devices use blow-apart contacts to rapidly interrupt the flow of high level short circuit or fault currents. In such desvices, the lower electrical contact of the blow-apart contacts may be stationary; or it may be movable. Stationary lower electrical contacts have often required the use of shims or trial and error procedures to precisely adjust the position of the electrical contact above the base of the circuit breaker. In addition, stationary lower electrical contacts used in the prior art are not conducive to adjustments in contact pressure and often require the changing of the operating springs used in the circuit breaker in order to obtain higher contact pressure for higher current ratings.

While many prior art devices have provided adequate protection against fault conditions in an electrical circuit, a need exists for dimensionally small molded case circuit breakers capable of fast, effective and reliable operation and, more specifically, for a compact, easily adjustable stationary lower electrical contact.

SUMMARY OF THE INVENTION

An object of the present invention is to provide a new and improved circuit breaker.

Another object of the present invention is to provide a new and improved molded case circuit breaker having a compact, adjustable stationary lower electrical contact.

Briefly, the present invention relates to a molded case circuit breaker having an adjustable stationary lower electrical contact that occupies a relatively small amount of space while providing fast, effective and reliable operation in protecting an electrical circuit or system from electrical fault conditions. The adjustable stationary lower electrical contact includes a one-piece formed copper contact and a separately formed, spacer bracket formed from a significantly less electrically conductive material.

Extending outwardly from the base of the circuit breaker is an integrally formed portion of the copper contact that forms an external electrical terminal of the circuit breaker. A base portion of the formed copper contact is positioned in a recess formed along the interior bottom surface of the base of the circuit breaker for properly locating the lower electrical contact. The formed copper contact also includes an integrally formed, stationary contact arm, the upper end of which has fixedly secured thereto a contact for physically and electrically contacting a movable upper electrical contact of the circuit breaker. The spacer bracket includes an integrally formed base portion supported above the base portion of the formed copper contact by a plurality of integrally formed, deflectable legs. An integrally formed, upstanding spacer leg extends from the base portion of the spacer bracket to an integral copper contact support portion of the spacer bracket that is fixedly secured to the underside of the upper end of the stationary contact arm.

An aperture is formed through the base portion of the formed copper contact in line with an aperture formed through the bottom surface of the base of the circuit breaker and also in line with a threaded aperture formed through the base portion of the spacer bracket. A mounting screw is received through these three apertures for securing the lower electrical contact in position in the base of the circuit breaker and for precisely adjusting the vertical height above the base of the circuit breaker of the contact fixedly secured to the stationary contact arm. By tightening the mounting screw, the legs of the spacer bracket deflect to reduce the space between the base portions of the formed copper contact and the spacer bracket, thereby lowering the copper contact support portion of the spacer bracket and the longitudinal end of the stationary contact arm fixedly secured thereto.

By tightening or loosening the mounting screw, the vertical distance between the contact fixedly secured to the stationary contact arm can be precisely adjusted. Such adjustment enables the contact pressure between the upper and lower electrical contacts to be increased for higher current ratings without changing the operating springs of the circuit breaker.

While the lower electrical contact is stationary in operation, blow-apart capability of the upper and lower electrical contacts is present due to the configuration of the formed copper contact that provides an elongated current path substantially parallel to an elongated current path through the movable upper electrical contact, resulting in high magnetic repulsion forces upon the occurrence of a high level short circuit or fault current condition. Upon such occurrence, the movable upper electrical contact rapidly separates from the lower electrical contact to increase the length and electrical resistance across the electrical arc, thereby limiting and eventually interrupting the flow of fault current.

BRIEF DESCRIPTION OF THE DRAWING

The above and other objects and advantages and novel features of the present invention will become apparent from the following detailed description of the preferred and alternative embodiments of a molded case circuit breaker illustrated in the accompanying drawing wherein.

DESCRIPTION OF THE PREFERRED EMBODIMENT

Figures 1, 2, 3, 4, 5:
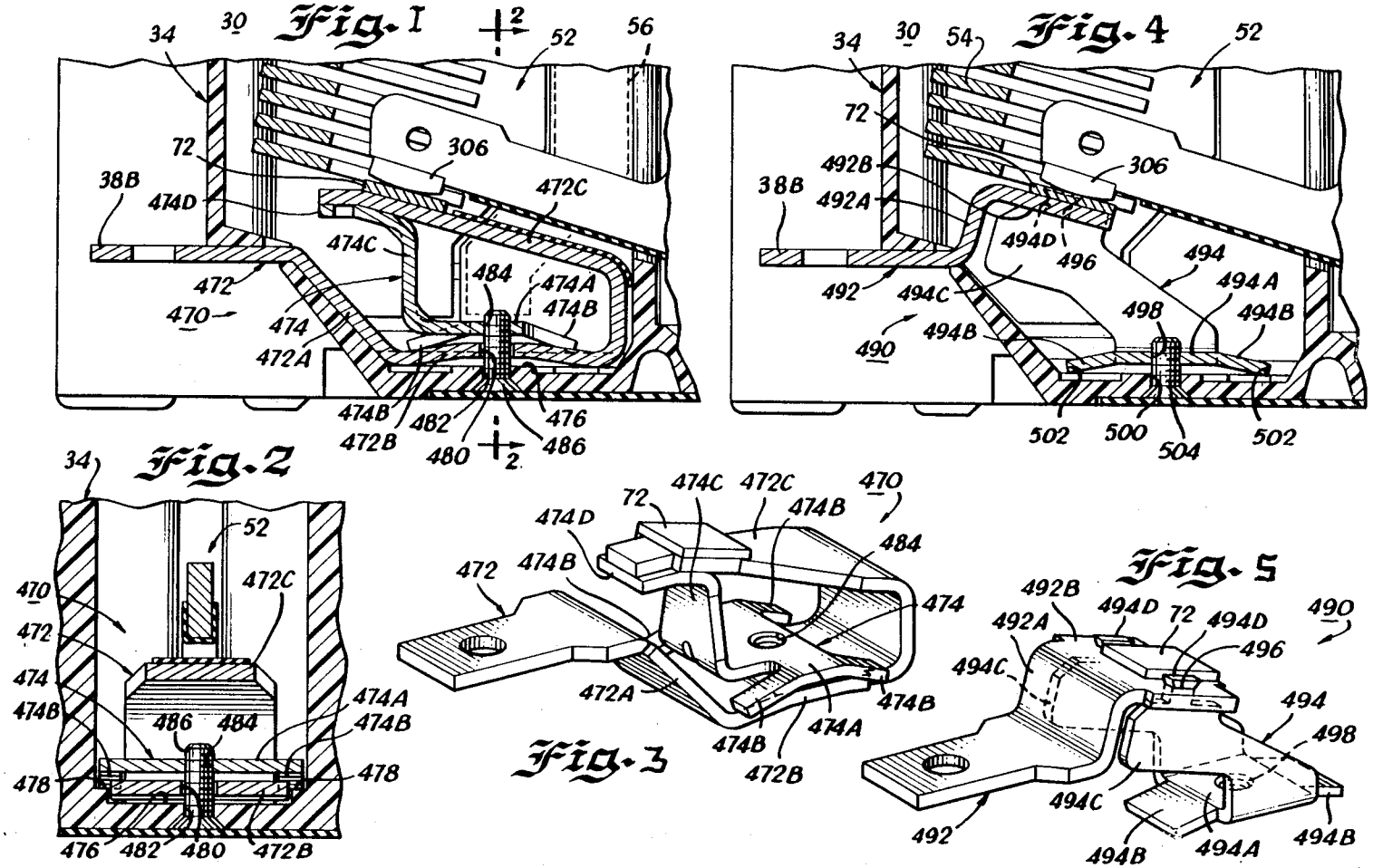
FIG. 1 is an enlarged, fragmentary, cross sectional view of a circuit breaker adjustable stationary lower electrical contact.
FIG. 2 is an enlarged, fragmentary, cross sectional view of the device of FIG. 1 taken along line 2—2 of FIG. 1.
FIG. 3 is an enlarged, perspective view of the electrical contact of FIG. 1.
FIG. 4 is an enlarged, fragmentary, cross sectional view of an alternative embodiment of the device of FIG. 1, depicting an alternative stationary lower electrical contact.
FIG. 5 is an enlarged, perspective view of the electrical contact of FIG. 4.

The present invention is directed to electrical contacts used in molded case circuit breakers. A detailed description of a molded case circuit breaker in which the contacts of the present invention can be utilized is set forth from page 7, line 30 to page 30, line 33 of U.S. Application Ser. No. 562,643, filing date Dec. 19, 1983, which description is incorporated hereinto by reference.

In accordance with the present invention (FIGS. 1–3), an adjustable, stationary, lower electrical contact 470 includes an integral or one-piece former copper contact 472 and a separately formed, spacer bracker 474 formed from a material having significantly less conductivity than copper, for example, steel. Extending outwardly from the base 34 is an integrally formed portion of the copper contact 472 that forms the first electrical terminal or the line terminal 38B. The formed copper contact 472 also includes an integral, inclined surface 472A complementarily shaped to an inclined interior surface of the base 34 for engagement therewith. An integrally formed base portion 472B is positioned in a recess 476 (FIG. 2) formed along the interior bottom surface of the base 34 for locating the lower electrical contact 470 in its proper position in the base 34. The formed copper contact 472 also includes an integrally formed, elongated stationary contact arm 472C that supports near its upper end a contact 72 fixedly secured thereto, for example, by brazing.

The spacer bracket 474 includes an integrally formed base portion 474A supported above the base portion 472D by a plurality of integrally formed, deflectable legs 474B. An integrally formed, upstanding spacer leg 474C extends from the base portion 474A to an integrally formed, copper contact support portion 474D. The copper contact support portion 474D is fixedly secured to the underside of the upper end of the contact arm 472C by any suitable means, for example, by a rivet or by brazing.

Preferably, the deflectable legs 474B are positoned on and in contact with a raised shoulder portion 478 that extends upwardly from the interior bottom surface of the base 34. An aperture 480 is formed through the base portion 472B in line with both an aperture 482 formed through the bottom surface of the base 34 and a threaded aperture 484 formed through the base portion 474A. The aligned apertures 480, 482 and 484 receive a mounting screw 486 that secures the lower electrical contact 470 in its position in the base 34 and that adjusts the vertical height of the contact 72 above the base 34. By tightening the mounting screw 486, the legs 474B deflect to reduce the space between the base portions 472B and 474A, thereby lowering the copper contact support portion 474D and the longitudinal end of the stationary contact arm 472C fixedly secured thereto.

Thus, by tightening or loosening the mounting screw 486, the vertical distance between the contact 72 and the base 34 can be precisely adjusted without the use of shims or trial and error procedures commonly resorted to in the prior art. In addition, after determining the desired amount of over-travel of the upper electrical contact 52, the subsequent precise adjustment of the lower electrical contact 470 in each pole or phase of the circuit breaker 30 results in less work being required to place the circuit breaker 30 in its CLOSED position, reducing the required size of and the stress on the operating springs (not shown) and the force required to move the handle (not shown) from its OPEN position to its CLOSED position. The adjustable lower electrical contact 470 also permits the contact pressure between the contacts 72 and 306 to be increased for higher current ratings without changing the operating springs 92.

While the lower electrical contact 470 is stationary in operation, blow-apart capability of the electrical contacts 52 and 470 is present due to the configuration of the formed copper contact 472 that provides parallel current paths in the contacts 52 and 470, resulting in high magnetic repulsion forces upon the occurrence of a high level short circuit or fault current condition. Upon such a condition, the electrical contact 52 will rapidly separate from the electrical contact 470 and assume its BLOWN-OPEN position. The slot motor 56 may be utilized to achieve rapid separation of the contacts 52 and 470.

In accordance with an alternative embodiment (FIGS. 4 and 5) of the circuit breaker 30, a stationary lower electrical contact 490 includes an integral or one-piece formed copper contact 492 supported in the base 34 by a support bracket 494, preferably formed from a material of significantly less electrical conductivity than copper, such as steel. The formed copper contact 492 includes an integrally formed portion extending exteriorly of the interior of the base 34 that forms the first terminal or line terminal 38B. The formed copper contact 492 also includes an upwardly extending inclined surface 492A and a contact mounting or support surface 492B that also functions as an arc runner to transfer an electrical arc formed between the separating upper and lower electrical contacts 52 and 490 to the arc chute 54. A contact 72 is fixedly secured to the support surface 492B by any suitable means, for example, by brazing. The support bracket 494 includes a lower base portion 494A, a pair of positioning or support legs 494B and a pair of integrally formed, upwardly extending support arms 494C that include upwardly projecting tabs 494D extending upwardly from the support arms 494C. The tabs 494D are configured to be received within a pair of complementarily shaped apertures 496 formed through the support surface 492B. When the tabs 494D are inserted through the apertures 496, the tabs 494D are spun over or peened to fixedly secure the formed copper contact 492 in engagement with the support bracket 494. A threaded aperture 498 is formed through the base portion 494A and is aligned with an aperture 500 formed through the bottom surface of the base 34 when the outermost edges or surfaces of the support legs 494B are positioned in engagement with the locating surfaces 502 integrally formed along the bottom surface of the base 34. A threaded mounting screw 504 is received in the aperture 500 and threadedly engages the aperture 498 to securely retain the stationary lower electrical contact 490 in engagement with the base 34.

The stationary lower electrical contact 490 may be used in molded case circuit breakers 30 having lower current ratings than those of the referenced circuit breaker 30 where blow-open capability of the circuit breaker 30 is not required. As is apparent from the configuration of the lower electrical contact 490, a parallel current path between elongated portions of the electrical contacts 52 and 490 does not exist; and, thus, the large magnetic repulsion forces discussed with respect to the referenced circuit breaker 30 are not generated.

Obviously, many modifications and variations of the present invention are possible in light of the above teachings. Thus it is to be understood that, within the scope of the appended claims, the invention may be practiced otherwise than as specifically described hereinabove.

What is claimed and desired to be secured by Letters Patent is:

1. An electrical circuit breaker comprising a base, a movable electrical contact and an adjustable stationary electrical contact, said movable and stationary electrical contacts being movable into a CLOSED position and into an OPEN position, said stationary electrical contact comprising a formed spacer bracket, a separate, formed conductive contact having an elongated stationary contact arm disposed above and secured to said spacer bracket, contact means fixedly secured to said stationary contact arm for physically and electrically contacting said movable electrical contact, and spacer means comprising a plurality of deflectable members in contact with said base for maintaining said contact means spaced from said base, said stationary electrical contact further comprising means for controllably adjusting and fixedly maintaining the spatial position of said contact means within said circuit breaker, said adjusting and maintaining means determining the amount of deflection of said deflectable members which adjusts the distance between said contact means and said base.

2. An electrical circuit breaker as recited in claim 1 wherein said formed contact includes an integrally formed, first base portion spaced apart from said contact means, the distance between said contact means and said first base portion being adjustable by said adjusting and maintaining means.

3. An electrical circuit breaker comprising a movable electrical contact and an adjustable stationary electrical contact, said movable and stationary electrical contacts being movable into a CLOSED position and into an OPEN position, said stationary electrical contact comprising a formed spacer bracket, a separate, formed conductive contact having an elongated stationary contact arm disposed above and secured to said spacer bracket, and contact means fixedly secured at one longitudinal end of said stationary contact arm for physically and electrically contacting said upper electrical contact, said formed contact including an integrally formed, first base portion spaced apart from said contact means, said spacer bracket including a second base portion spaced apart from said first base portion, and said stationary electrical contact further comprises spacer means comprising a plurality of deflectable members for maintaining said second base portion spaced from said first base portion, said stationary electrical contact further comprising means for controllably adjusting and fixedly maintaining the spatial position of said contact means within said circuit breaker, the distance between said contact means and said first base portion being adjustable by said adjusting and maintaining means, and the amount of the deflection of said deflectable members being determined by said adjusting and maintaining means.

4. An electrical circuit breaker as recited in claim 3 wherein said stationary contact arm provides an elongated current path substantially parallel to an elongated current path through said movable electrical contact when said contacts are in said CLOSED position.

5. An electrical circuit breaker as recited in claim 3 further comprising a molded case formed of electrically insulating material within which said movable and stationary electrical contacts are disposed.

6. An electrical circuit breaker comprising:

a movable electrical circuit;

an adjustable stationary electrical contact, said movable and stationary electrical contacts being movable into a CLOSED position and into an OPEN position, said stationary electrical contact comprising:

a one-piece formed copper contact comprising an integrally formed, first base portion and an integrally formed elongated stationary contact arm disposed above said first base portion;

contact means fixedly secured to said stationary contact arm for physically and electrically contacting said movable electrical contact;

a separately formed spacer bracket comprising a second base portion and a contact support portion, said contact support portion being fixedly secured to said stationary contact arm and said second base portion being spaced from said first base portion; and means for controllably adjustably maintaining the spacing between said first base portion and said contact means, said controllably adjustably maintaining means comprising an elongated threaded fastener retained in threaded engagement with a threaded aperture formed through said second base portion, the spacing between said contact means and said first base portion being controllably adjustable in response to the tightening or loosening of said threaded fastener; and spacer means comprising a plurality of deflectable legs for spacing apart said first and second base portions, the amount of the deflection of said legs being determined by said threaded engagement of said threaded fastener with said threaded aperture.

7. An electrical circuit breaker comprising a movable electrical contact, a stationary electrical contact, means for enclosing at least portions of said movable and stationary electrical contacts, and an electrical arc chute disposed within said enclosing means, said movable and stationary electrical contacts being movable into a CLOSED position and into an OPEN position within said enclosing means, said stationary electrical contact comprising a one-piece formed copper contact and a separately formed spacer bracket, said copper contact comprising an integrally formed terminal means for forming an electrical terminal of said circuit breaker and an integrally formed contact support portion, said terminal means extending exteriorly of the interior of said enclosing means and said contact support portion being disposed within said enclosing means, said stationary electrical contact further comprising contact means fixedly secured to said contact support portion for physically and electrically contacting said movable electrical contact, said arc chute having a portion thereof disposed adjacent said copper contact intermediate said terminal means and said contact means, said copper contact transferring an electrical arc formed between said movable and stationary electrical contacts to said arc chute, said spacer bracket comprising a base portion and a spacer portion, said spacer portion being fixedly secured to said contact support portion for spacing said contact means from said base portion, said spacer bracket further comprising a plurality of deflectable members operatively connected to said base portion, and said enclosing means for spatially positioning said contact means within said enclosing means, said stationary electrical contact further comprising means for controllably adjusting and fixedly maintaining the spatial position of said contact means within said enclosing means, the distance between said contact means and said enclosing means being adjustable by said adjusting and maintaining means, the amount of the deflection of said deflectable members being determined by said adjusting and maintaining means to adjust the distance between said contact means and said enclosing means.

8. An electrical circuit breaker as recited in claim 7 wherein said enclosing means comprises a molded case formed from electrically insulating material.

9. An electrical circuit breaker comprising a base, a movable electrical contact and an adjustable stationary electrical contact, said movable and stationary electrical contacts being movable into a CLOSED position and into an OPEN position, said stationary electrical contact comprising a formed spacer bracket, a separate, formed conductive contact having an elongated stationary contact arm disposed above and secured to said spacer bracket, contact means fixedly secured to said stationary contact arm for physically and electrically contacting said movable electrical contact, and spacer means comprising a plurality of deflectable legs in contact with said base for spacing apart said contact means and said base, said stationary electrical contact further comprising means for controllably adjusting and fixedly maintaining the spatial position of said contact means within said circuit breaker, said adjusting and maintaining means comprising an elongated threaded fastener retained in threaded engagement with a threaded aperture formed through said spacer bracket, the amount of the deflection of said legs being determined by said threaded engagement of said threaded fastener with said threaded aperture.

* * * * *